US005379998A

United States Patent [19]

Nakagawa

[11] Patent Number: 5,379,998

[45] Date of Patent: Jan. 10, 1995

[54] MANUAL SHEET FEEDING APPARATUS HAVING MANUAL SHEET FEEDING SWITCH NEAR SHEET GUIDE

[75] Inventor: Shin Nakagawa, Nagoya, Japan

[73] Assignee: Brother Kogyo Kabushiki Kaisha, Nagoya, Japan

[21] Appl. No.: 249,660

[22] Filed: May 26, 1994

Related U.S. Application Data

[63] Continuation of Ser. No. 970,830, Nov. 3, 1992, abandoned.

[30] Foreign Application Priority Data

Nov. 6, 1991 [JP] Japan ..... 3-319925

[51] Int. Cl.[6] ..... B65H 9/16

[52] U.S. Cl. ..... 271/248; 271/236; 271/245; 271/253; 271/265

[58] Field of Search ..... 271/9, 226, 227, 236, 271/242, 245, 248, 253, 264, 265, 109, 110

[56] References Cited

U.S. PATENT DOCUMENTS 4,548,401 10/1985 Nishikawa ..... 271/265

FOREIGN PATENT DOCUMENTS 8947 1/1987 Japan ..... 271/264

60842 3/1988 Japan ..... 271/265

*Primary Examiner*—Robert P. Olszewski

*Assistant Examiner*—Boris Milef

*Attorney, Agent, or Firm*—Oliff & Berridge

[57] ABSTRACT

A manual sheet feeding apparatus for manually feeding a cut sheet into a printer, including a paper pan for supporting the cut sheet manually inserted to a predetermined position, a sheet guide provided on the paper pan, for guiding the cut sheet along one edge thereof, a sheet advancing device for advancing the manually inserted cut sheet in a sheet advancing direction parallel to the one edge, in contact with the cut sheet, and an operator-controlled switch for starting an operation of the sheet advancing means to advance the cut sheet. The operator-controlled switch is disposed near the sheet guide, so that the switch can be easily operated with the operator's hand used to manually insert and hold the sheet.

10 Claims, 7 Drawing Sheets

MANUAL SHEET FEEDING APPARATUS HAVING MANUAL SHEET FEEDING SWITCH NEAR SHEET GUIDE

This is a continuation of application Ser. No. 07/970,830 filed Nov. 3, 1992, now abandoned.

BACKGROUND OF THE INVENTION

1. Field of the Invention

The present invention relates to an apparatus for manually feeding a cut sheet into a printer, which apparatus has a sheet guide for guiding the sheet when the sheet is manually inserted, and an operator-controlled switch to start feeding the manually inserted sheet.

2. Discussion of the Prior Art

In a printer capable of printing on a manually inserted cut sheet, a manual sheet feeding apparatus is provided in a rear upper portion or a front lower portion of the printer. On the other hand, an operator-controlled key switch for starting a drive system for advancing the manually inserted sheet toward and past the printing station is provided on an operator's control panel which is disposed in an upper part of the front surface of the printer, for example. When the cut sheet is first manually inserted to a predetermined position in the printer, the sheet is moved with one lateral edge thereof being guided by a sheet guide such that the sheet is held by a hand of the operator. Usually, the key switch to start the sheet advancing operation is disposed a considerable distance away from the sheet guide. Hence, the operator's hand engaged in holding the sheet for guiding along the sheet guide cannot be used for almost concurrently operating the key switch. Therefore, the other hand of the operator is used to operate the key switch on the operator's control panel after the sheet has been manually inserted by the above-indicated one hand. Alternatively, the operator's hand once used for inserting and positioning the sheet along the sheet guide is released from the sheet, and the key switch is then operated by the same hand.

In the former case in which the two hands of the operator are used to manually insert the sheet and operate the key switch, the operator has to move the point of view a considerable distance from the sheet (sheet guide) to the key switch on the operator's control panel, which is considerably spaced apart from the sheet guide. Accordingly, it is difficult to operate the key switch as soon as the sheet has been manually inserted in position. Therefore, the manual sheet inserting operation is cumbersome and is not efficient, particularly when the cut sheets are successively manually fed.

In the latter case in which the same hand is used to first manually position and insert the sheet and then operate the key switch, the operator has to move that hand and the point of view from the sheet to the key switch. Accordingly, a relatively long time is required after the sheet has been manually inserted, and before the key switch is operated.

SUMMARY OF THE INVENTION

It is therefore an object of the present invention to provide a manual sheet feeding apparatus for a printer, which apparatus permits the operator to operate by one hand a start switch for starting the sheet advancing movement, as soon as a cut sheet has been manually inserted by the same hand.

It is a second object of this invention to provide a manual sheet feeding apparatus for a printer, which apparatus permits efficient manual insertion of the cut sheet and operation of the start switch, without a large movement of the operator's hand and view point from the sheet and sheet guide to the start switch.

The terms "manual sheet feeding apparatus" used herein is interpreted to mean an apparatus adapted to automatically advance a cut sheet toward and past a printing station of a printer after the cut sheet is manually inserted and positioned in place in the printer by the operator or user of the printer.

The above objects may be achieved according to the principle of the present invention, which provides a manual sheet feeding apparatus for manually feeding a cut sheet into a printer, comprising: (a) a paper pan for supporting the cut sheet manually inserted to a predetermined position; (b) a sheet guide provided on the paper pan, for guiding the cut sheet along one edge thereof; (c) sheet advancing means disposed ahead of said paper pan, for advancing the cut sheet manually inserted, in a sheet advancing direction parallel to the one edge, in contact with the cut sheet; and (d) operator-controlled commanding means for starting an operation of the sheet advancing means to advance the cut sheet. The apparatus is characterized in that the operator-controlled commanding means is disposed near the sheet guide.

In the manual sheet feeding apparatus of the present invention constructed described above, the operator-controlled commanding means is disposed near the sheet guide, and is therefore operable by an operator's hand used for manual insertion of the cut sheet, as soon as the manual sheet insertion is completed. Where the commanding means is disposed within the reach of the thumb of the operator's hand engaged in holding the sheet after the sheet has been inserted, the operator does not have to move the hand from the sheet toward the commanding means. Accordingly, the manual sheet insertion can be conducted with improved efficiency.

If the commanding means is not within the reach of the thumb of the hand engaged in holding the sheet, the operator has to move the hand and the view point only a small distance to operate the commanding means, since the commanding means is disposed near the sheet guide, for example, a maximum of 15 cm from the sheet guide in the direction perpendicular to the guiding surface of the sheet guide.

BRIEF DESCRIPTION OF THE DRAWING

The above and other objects, features and advantages of the present invention will be better understood by reading the following details description of presently preferred embodiments of the invention, when considered in connection with the accompanying drawings, in which.

DETAILED DESCRIPTION OF THE PREFERRED EMBODIMENTS

Figure 1:
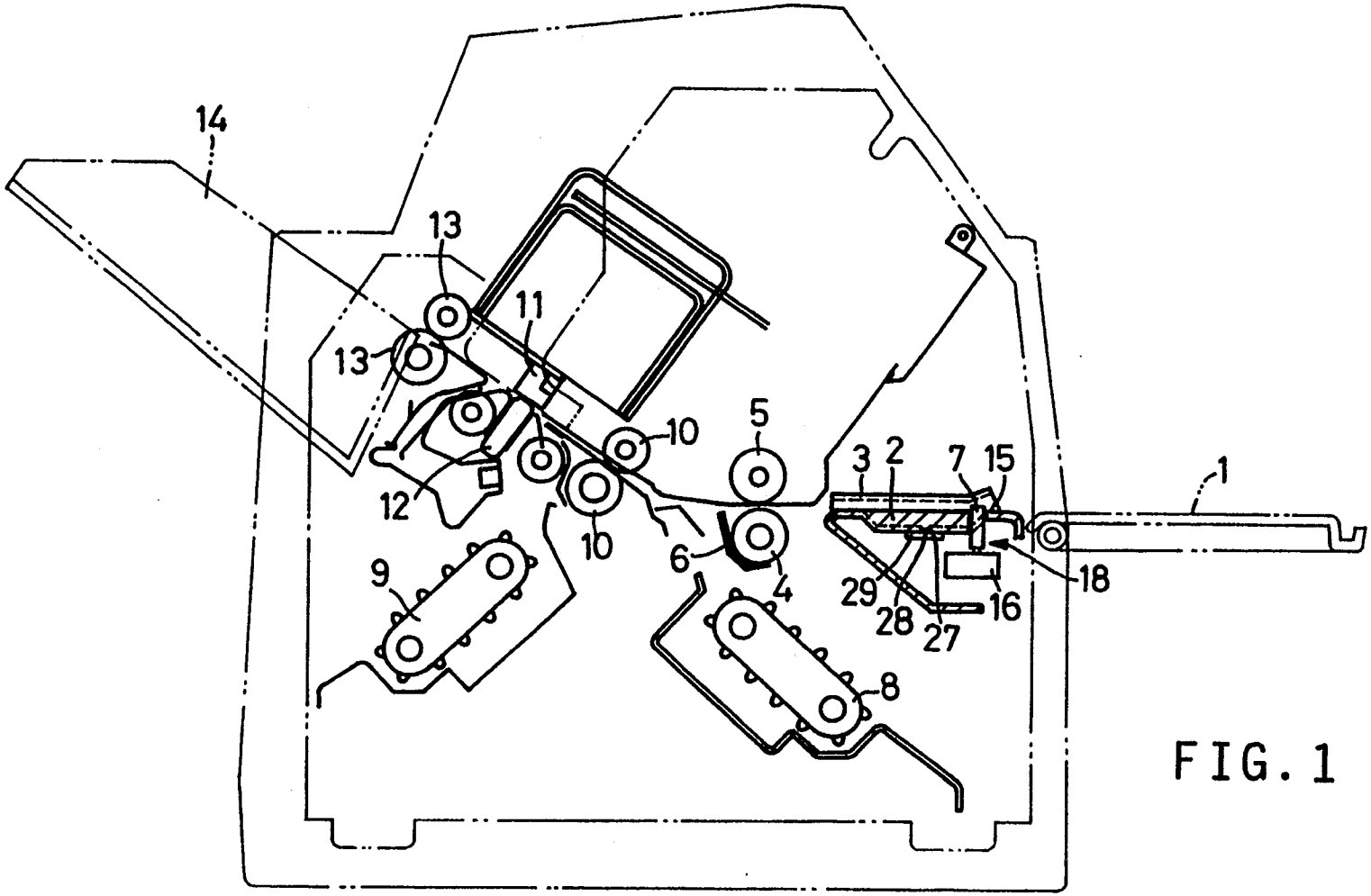
FIG. 1 is a schematic elevational view illustrating a printer incorporating one embodiment of a manual sheet feeding apparatus of this invention.

Referring first to FIGS. 1–4, a printer incorporating a manual sheet feeding apparatus constructed according to one embodiment of this invention has a covering member 1 pivotally supported at one end thereof. The covering member 1 has a vertical position in which the covering member 1 provides a portion of the side surface at the above-indicated end of the printer, and a horizontal position as shown in FIG. 1, in which the covering member 1 functions as a sheet support on which a cut sheet P (FIGS. 2 and 3) is placed when the sheet P is manually inserted and advanced for printing thereon. The printer has a paper pan 2 disposed within its frame, adjacent the axis about which the covering member 1 is pivotable between the vertical and horizontal positions. When the sheet P is manually inserted from the covering member 1 in the horizontal position, the sheet P is slidably moved on the paper pan 2. The covering member 1 placed in the horizontal position will be hereinafter referred to as "sheet support".

Figure 2:
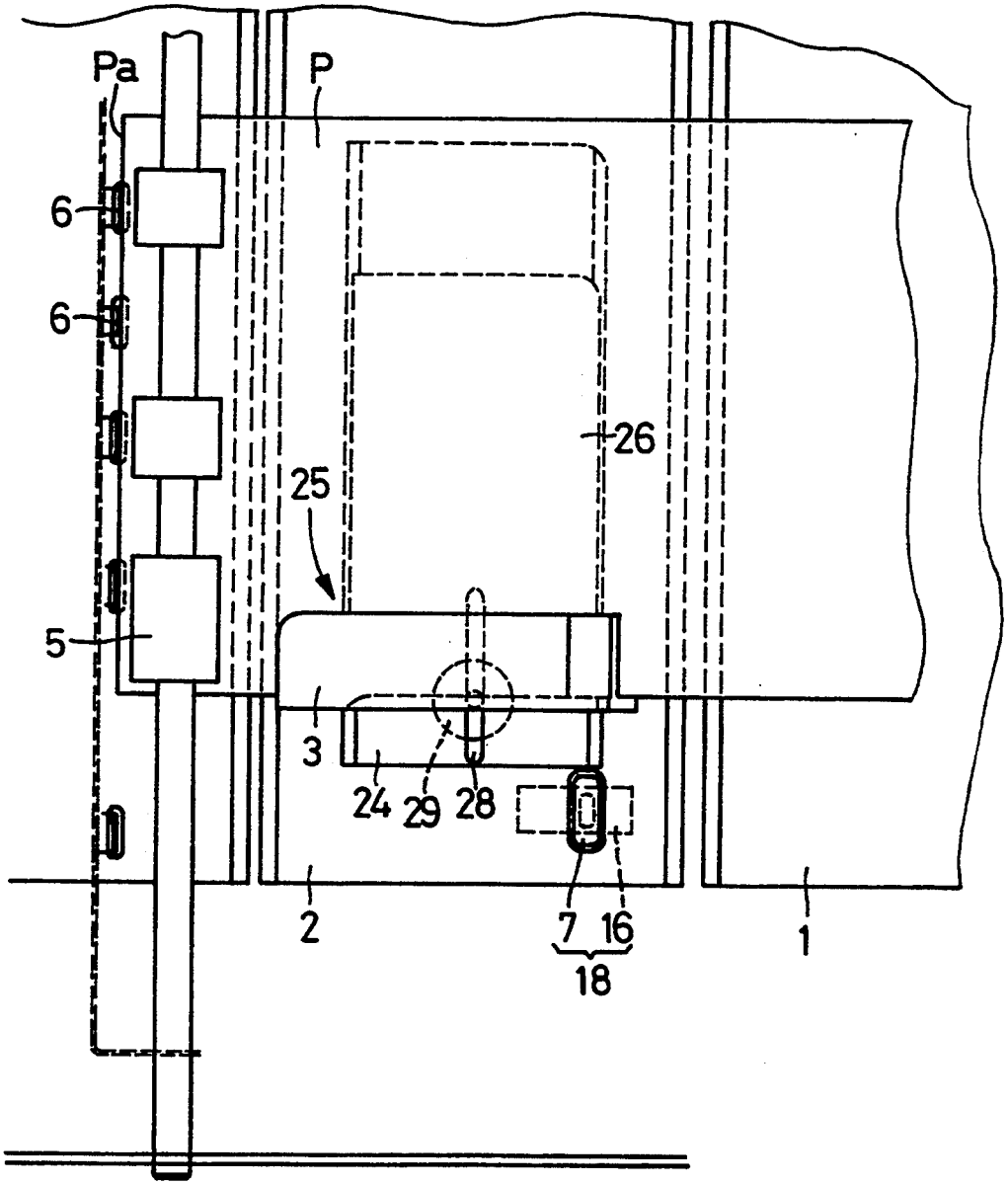
FIG. 2 is a fragmentary plan view showing the manual sheet feeding apparatus in its ready state for manual feeding of a sheet into the printer.

On the paper pan 2, there is provided a sheet guide 3 for guiding the sheet P along one lateral edge thereof, as shown in FIG. 2, when the sheet P is manually inserted into the printer. As described below by reference to FIG. 5, this sheet guide 3 is movable in the direction perpendicular to the sheet inserting direction, so that the sheet guide 3 can guide cut sheets P having different sizes. A pair of feed rolls 4, 5 is provided ahead of the paper pan 2 as seen in the sheet inserting direction. The feed rolls 4, 5 are adapted to advance the manually insert cut sheet P, such that the sheet P is passed through the nip of the roller 4, 5, as shown in FIG. 4.

Figure 3:
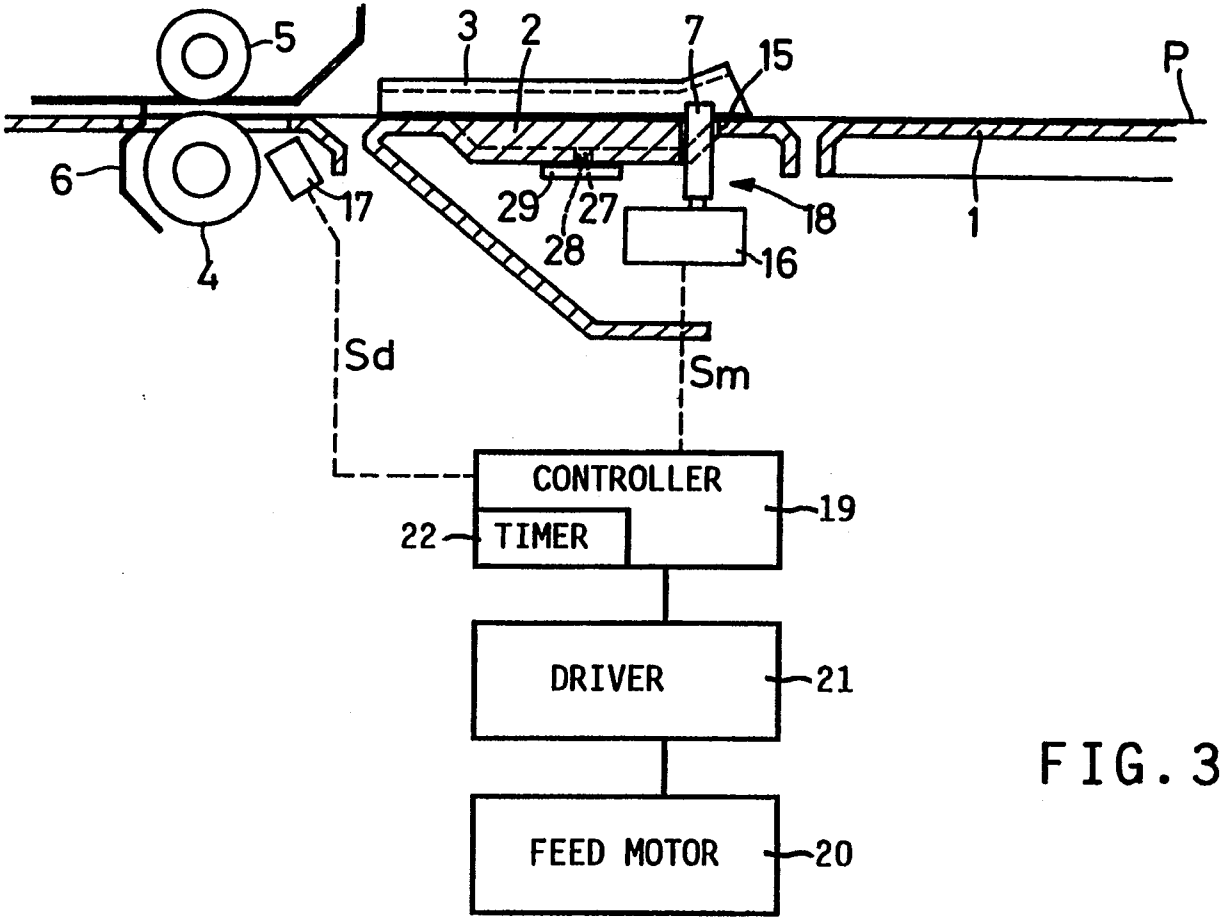
FIG. 3 is a schematic elevational view of the manual sheet feeding apparatus in its ready state.

The cut sheet P is manually inserted from the sheet support 1 until the leading edge Pa of the sheet P is advanced to a predetermined position defined by two sheet stops 6, as shown in FIGS. 2 and 3. Thus, the feed rolls 4, 5 are disposed between the paper pan 2 and the sheet stops 6, as seen in the sheet inserting direction. The sheet stops 6 cooperate with the sheet guide 3 to register the sheet P which has been manually inserted. A key 7 is supported by the paper pan 2 such that the key 7 is movable between a non-operated position and an operated position. The key 7 is disposed near the sheet guide 3 in its leftmost position for guiding the sheet P having the largest size, as shown in FIG. 2. That is, the key 7 is spaced apart a small distance (which will be described) from the sheet guide 3 in the leftmost position, in the direction perpendicular to the direction of extension of the sheet guide 3. In the non-operated position indicated in FIG. 3, the top surface or operating surface of the key 7 is located slightly above the top surface of the paper pan 2. In the operated position, the operating surface of the key 7 is almost flush with the top surface of the paper pan 2.

The printer has an automatic web feeding system which includes a first and a second web tractor 8, 9 for automatically feeding a web. The printer also has a pair of advancing rolls 10 for further advancing the sheet P past a printing station defined by and between a print head 11 and a platen 12. The sheet P on which printing is effected by the print head 11 is ejected onto a tray, by a pair of ejector rolls 13 disposed downstream of the printing station, as seen in the sheet advancing direction.

Figure 4:
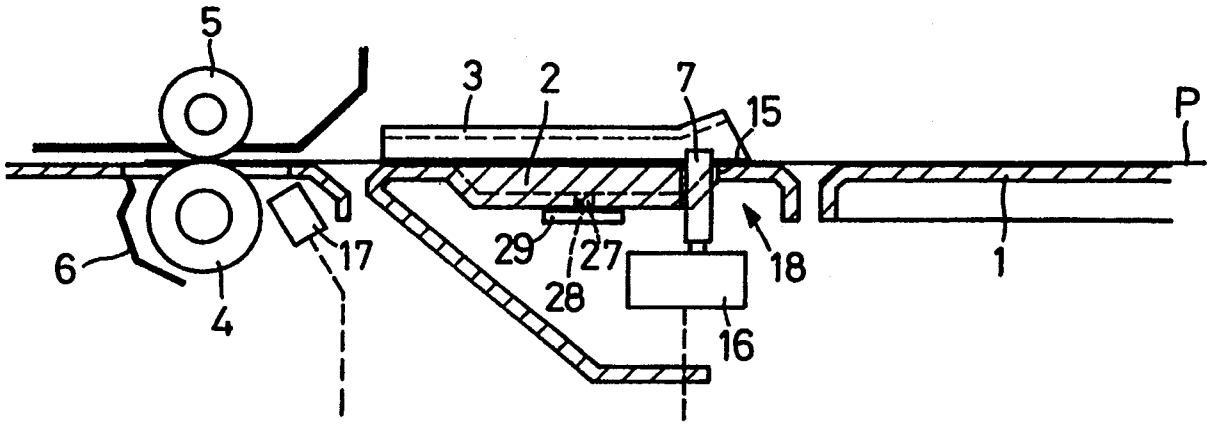
FIG. 4 is a view showing the manual sheet feeding apparatus while the sheet is manually fed.

The key 7 indicated above is movably received in a through-hole 15 formed through the paper pan 2, as most clearly shown in FIGS. 3 and 4, so that the key 7 can be pressed down to its operated position by the operator. The lower end of the stem of the key 7 is associated with a switch 16 fixed to the paper pan 2, such that the switch 16 generates a FEED START signal Sm, in response to a downward movement of the key 7. It will be understood that the key 7 and the switch 16 cooperate to constitute a FEED START key switch generally indicated at 18 in FIGS. 1–4.

A sheet sensor 17 is provided adjacent to the lower feed roll 4. The sheet sensor 17 generates a SHEET DETECTION signal Sd indicating that the manually inserted sheet P is positioned in place, with the leading end of the sheet P located ahead of the sensor 7. That is, the SHEET DETECTION signal Sd is generated when the sheet P has been correctly manually inserted from the sheet support 1, with its lateral edge guided by the sheet guide 3.

The FEED START signal Sm and the SHEET DETECTION signal Sd are received by a controller 19, which controls a feed motor 20 through a driver 21, according to the received signals Sm and Sd, as indicated in FIG. 3 and as described below in detail by reference to the flow chart of FIG. 5. The controller 19 incorporates a timer 22 for measuring a length of time after the SHEET DETECTION signal Sd is generated, namely, a length of time during which the signal Sd is present.

Figure 5:
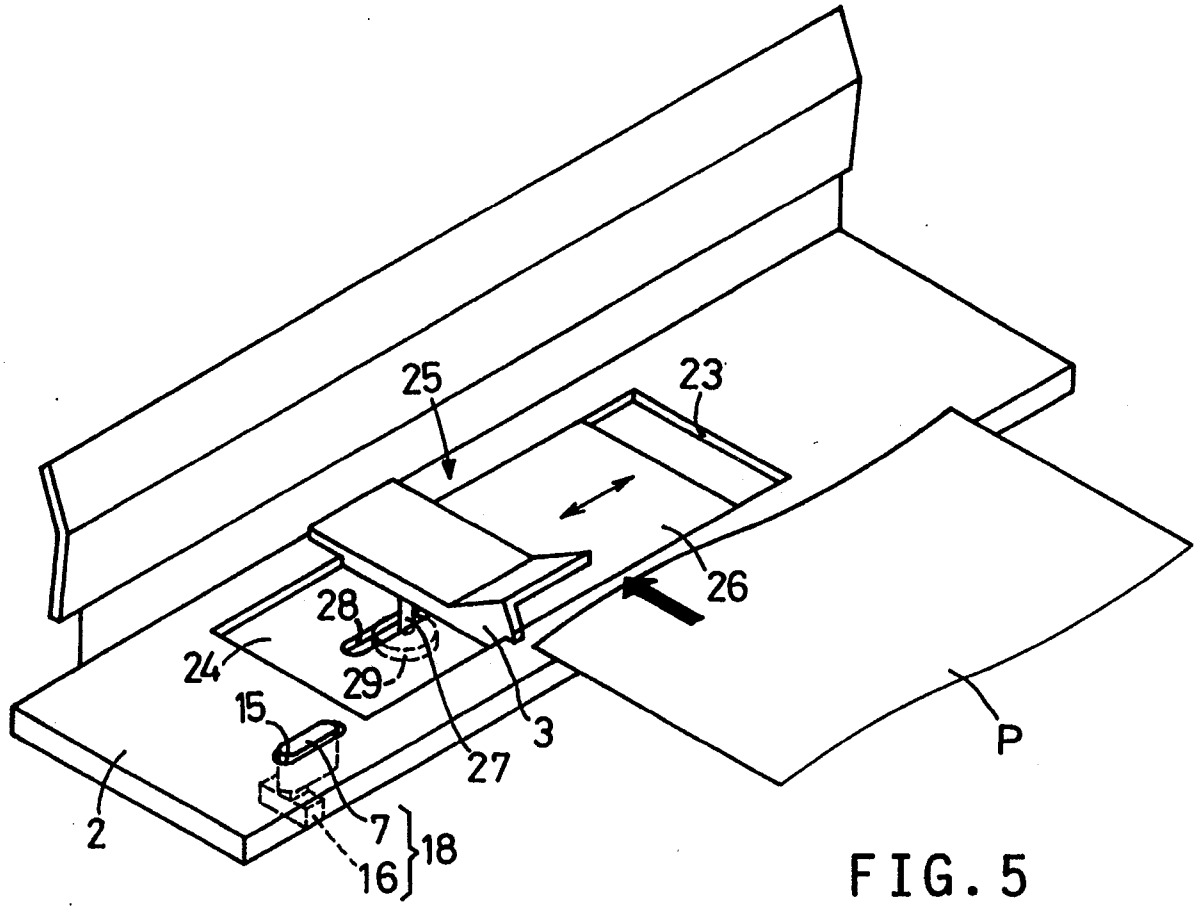
FIG. 5 is a perspective view showing a sliding member with a movable sheet guide, provided in the manual sheet feeding apparatus.

Referring next to FIG. 5, there will be described a structure for supporting the sheet guide 3 movably on the paper pan 2. The paper pan 2 has a rectangular recess 23 formed in a central portion thereof, such that the recess 23 extends in the direction perpendicular to the sheet inserting direction indicated by arrow in FIG. 5. The recess 23 has a depth smaller than the thickness of the paper pan 23, whereby the paper pan 2 has a thin-walled portion 24 corresponding to the recess 23.

The recess 23 accommodates a base 26 of a sliding member 25, such that the base 26 is slidably movable on the thin-walled portion 24, in the longitudinal direction of the recess 23. The sheet guide 3 is formed as an integral part of the sliding member 25, such that the sheet guide 3 extends in the upward direction from the left-hand side end of the base 26 as seen in the sheet inserting direction. The top surface of the base 26 is slightly lower than the top surface of the paper pan 2. The sliding member 25 further has a retainer portion 27 which extends through a hole 28 formed through the thickness of the thin-walled portion 24 of the paper pan 2. The retainer portion 27 has an enlarged end 29 having a size larger than the width of the hole 28, so that the retainer portion 27 with the enlarged end 29 cooperates with the hole 28 to permit the sliding member 25 to be frictionally moved relative to the paper pan 2 under a certain sliding resistance, while preventing the sliding member 25 from being removed from the recess 23. Thus, the position of the sheet guide 3 can be adjusted to the particular size of the paper sheet P, by moving the sliding member 25 in the direction perpendicular to the sheet inserting direction, against the sliding resistance. As described above, the FEED START key switch 18 is stationary relative to the paper pan 2.

For manually inserting the cut sheet P for printing thereon, the operator places the sheet P on the sheet support 1 and paper pan 2, and moves the sheet P on the paper pan 2 such that the sheet P is guided at one lateral edge thereof by the sheet guide 3. The sheet P is advanced until the leading edge Pa comes into abutting contact with the sheet stops 6 slightly ahead of the feed rolls 4, 5. In this condition, the feed rolls 4, 5 are spaced apart from each other as shown in FIG. 3. When the FEED START key switch 18 is then activated by pressing the key 7, the FEED START signal Sm is generated and applied to the control 19, which in turn activates suitable mechanisms for lowering the sheet stops 6 away from the feed path of the sheet P, and lowering the upper feed roll 5 toward the lower feed roll 4. As a result, the leading end portion of the sheet P is pinched by and between the feed rolls 4, 5. The sheet P is then advanced by the feed rolls 4, 5 and advancing rolls 10, which are rotated by the feed motor 20. As the sheet P is fed past the printing station, printing is effected on the sheet P by the print head 11. The printed sheet P is ejected onto the tray 14 by the ejector rolls 13, which are also driven by the feed motor 20. The rolls 4, 5, 10 and 13 are connected to the feed motor 20 by a suitable power transmission mechanism.

In the present embodiment, the sheet guide 3 and the FEED START key switch 18 are adapted to permit the operator to manually insert and position the cut sheet P by using the operator's right hand. Described in more detail by reference to FIG. 2, the sheet guide 3 serves to guide the cut sheet P such that the left edge of the sheet P as seen in the sheet inserting direction is in sliding contact with the sheet guide 3, while the FEED START key switch 18 is disposed to the left of the sheet guide 3 as seen in the sheet inserting direction. To insert and position the cut sheet P, the operator holds the sheet P with the fingers of the right hand except the thumb. Then, the operator presses the key 7 of the switch 18 with the thumb of the right hand, while the other four fingers of the same hand are holding the inserted and positioned sheet P, or after the four fingers are moved a small distance to the left. To enable the operator to manually insert the sheet P and press the key 7 without moving the view point and right hand a considerable distance, it is desirable that the top operating surface of the key 7 have substantially the same height as the top surface of the paper pan 2, and that the minimum distance between the key 7 and the sheet guide 3 in the leftmost position (for the maximum sheet size) be a maximum of 15 cm, in the direction perpendicular to the sheet inserting direction. For permitting the manual insertion and positioning of the sheet P and the pressing of the key 7 with the same hand (right hand) without a movement of the hand, the minimum distance is preferably a maximum value of 7 cm. In the present embodiment, the minimum distance between the key 7 and the sheet guide 3 in its leftmost position is selected to be 3 cm, for easy pressing of the key 7 with the thumb of the operator's right hand while the other four fingers of the same hand are holding the sheet P which has been inserted and positioned with those four fingers. In the present embodiment, the key 7 is located just to the left of the rear end of the sheet guide 3, namely, aligned with the rear end of the sheet guide 3 in the sheet inserting direction. If the key 7 is spaced from the rear end of the sheet guide 3 in the direction opposite to the sheet inserting direction, the above-indicated distances are measured from the rear end of the sheet guide 3 to a point of the key 7 which is nearest to the rear end of the sheet guide 3.

Figure 6:
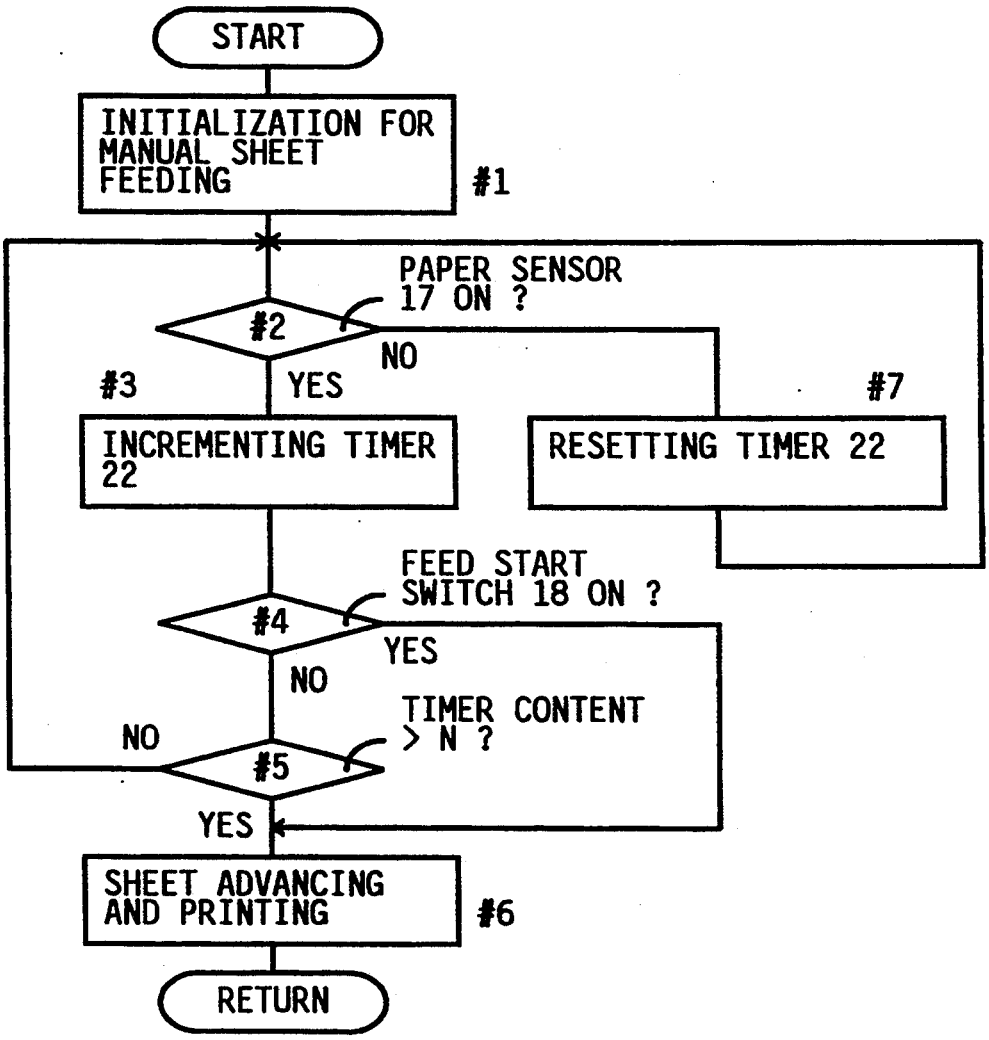
FIG. 6 is a flow chart illustrating a control routine for a printing operation on a manually fed sheet of paper.

The controller 19 has various control programs for controlling various operations of the printer, including a control routine for controlling an operation of the printer for printing on the cut sheet P which is manually inserted by the operator as described above. This control routine is illustrated in the flow chart of FIG. 6, by way of example. The routine is initiated when the manual sheet feeding mode is selected by an appropriate mode selector switch. When this mode selector switch is operated, the first and second web tractors 8 and 9 are placed in their inoperative position. The control routine of FIG. 6 is started with step #1 for initializing the printer to be ready for printing on the manually inserted cut sheet P. For instance, the initialization in step #1 includes: elevating the upper feed roll 5 away from the lower feed roll 4 to provide a small clearance therebetween, as indicated in FIG. 3; and bringing the sheet stops 6 in their operative position of FIG. 3. Step #1 is followed by step S2 to determine whether the sheet sensor 17 is ON, namely, whether or not the SHEET DETECTION signal Sd is received from the sensor 17. If a negative decision (NO) is obtained in step #2, the control flow goes to step #7 to reset the timer 22. If an affirmative decision (YES) is obtained in step #2, step #3 is implemented to increment the timer 22. Since the SHEET DETECTION signal Sd is generated when the cut sheet P has been manually inserted and positioned by the operator, steps #2 and #3 are provided to measure the time lapse after the sheet P has been manually inserted and positioned with its leading end portion passing the clearance between the two feed rolls 4, 5. Step #3 is followed by step #4 to determine whether the FEED START key switch 18 has been turned on, that is, whether or not the FEED START signal Sm has been received from the key switch 18. If an affirmative decision (YES) is obtained in step #4, or if the key 7 has been pressed to turn on the key switch 18, step #6 is implemented to perform a series of operations for printing on the manually inserted sheet P, which include: an operation to lower the upper feed roll 5 to establish the pressure nip with respect to the lower feed roll 4, for pinching the leading end of the manually inserted sheet P; an operation to bring the sheet stops 6 to the inoperative position; an operation to advance the sheet P by rotating the feed rolls 4, 5, advancing rolls 10 and ejector rolls 13; and an operation to activate the print head 11 to effect printing on the sheet P as the sheet P is passed through the printing station, i.e., between the print head 11 and the platen 12. As a result, the printed sheet P is finally ejected into the tray 13.

If the key switch 18 is not in the operated state or if the FEED START signal Sm has not been received, a negative decision (NO) is obtained in step #4, whereby the control flow goes to step #5 to determine whether or not the content of the timer 22 is larger than a predetermined value N. It will be understood that step #5 serves to determine whether or not the predetermined time corresponding to the predetermined value N has passed after the SHEET DETECTION signal Sd is received, that is, after the cut sheet P has been correctly inserted and positioned by the operator. If a negative decision (NO) is obtained in step #5, the control flow returns to step #2.

If the cut sheet P is pulled out of the printer or pulled back with the leading end portion located behind the sheet sensor 17, a negative decision (NO) is obtained in step #2 after a negative decision (NO) is obtained in step #5, namely, if the sheet detection signal Sd once received became absent within the predetermined time length corresponding to the value N. In this case, the control flow goes to step #7 to reset the timer 22.

If an affirmative decision (YES) is obtained in step #5, this means that the predetermined time corresponding to the predetermined value N has passed after the cut sheet P has been manually inserted, namely, after the affirmative decision (YES) is obtained in step #2. In this case, the control flow goes to step #6 to start feeding the sheet P and printing on the sheet P, as described above. It will thus be understood that the printing is initiated when the predetermined time, for example, about two seconds, has passed after the sheet P has been manually inserted, even before the FEED START switch 18 is turned on.

In the above embodiment, the sheet guide 3 formed as an integral part of the sliding member 25 is movable right and left relative to the paper pan 2 in the direction perpendicular to the sheet inserting direction, while the key 7 or key switch 18 is fixed in position relative to the paper pan 2. The maximum size of the sheet P for which the sheet guide 3 is moved to the leftmost position is selected to be the size which is most frequently used. When the sheet P of this size is used, the key 7 can be easily pressed with the thumb of the right hand the other fingers of which are used for holding the inserted sheet P, since the key 7 is spaced apart only 3 cm from the sheet guide 3. When the sheets P having smaller sizes are used, the sheet guide 3 is accordingly moved to the right, whereby the distance between the key 7 and the guide 3 is increased. However, the key 7 can be pressed by slightly moving the hand to the left after the sheet P has been inserted and positioned on the paper pan 2 with the aid of the sheet guide 3.

Figure 7:
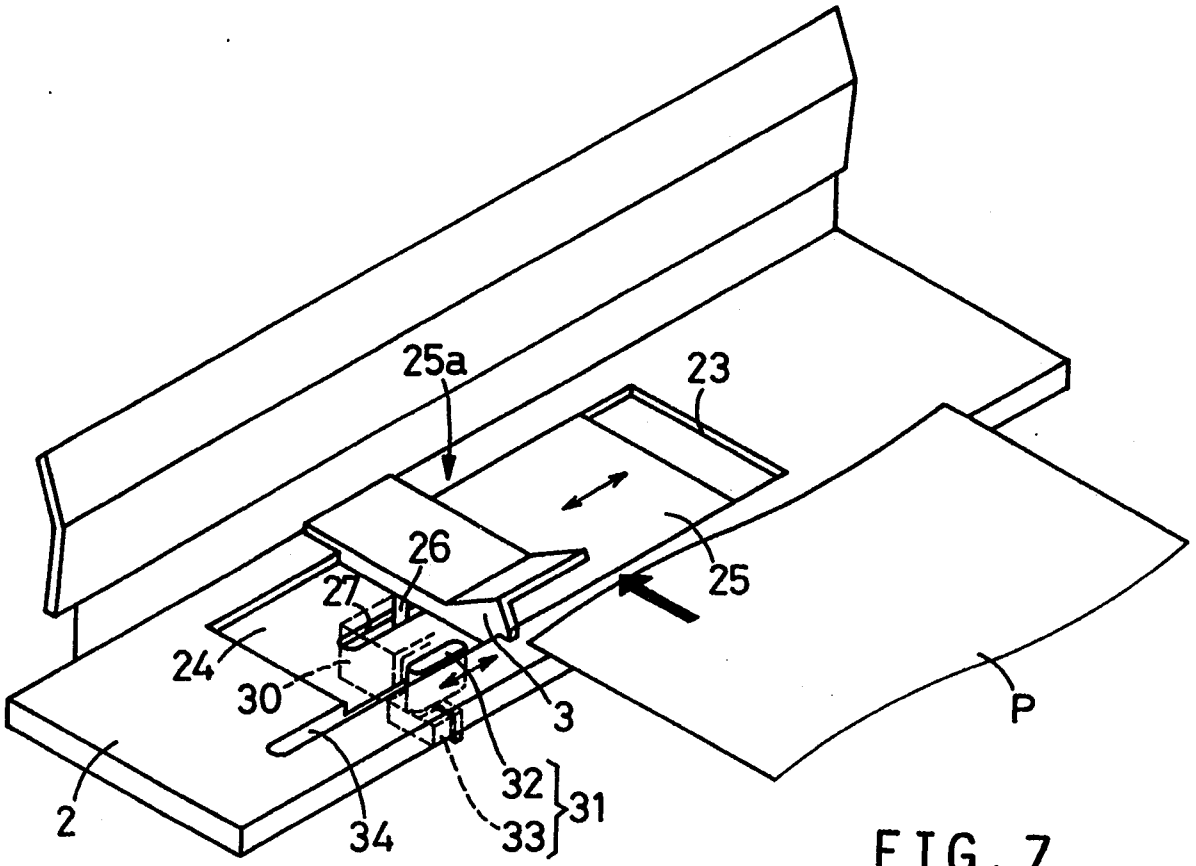
FIG. 7 is a perspective view showing a sliding member for moving together a movable sheet guide and a feed start key switch, provided in another embodiment of the present invention.

Referring to FIG. 7, there will be described another embodiment of the present invention, in which the sheet guide 3 is movable with the FEED START key switch indicated generally at 31 in the figure. This second embodiment uses a sliding member **25*a*, which is identical in construction with the member 25 of FIG. 5, except for a bracket portion 30 formed in place of the enlarged end 29. More specifically described, the bracket portion 30 is formed integrally with the retainer portion 26 such that the bracket portion 30 is located just below the underside of the paper pan 2. The bracket portion 30 supports a key 32 and a switch 33 of the key switch 31, such that the key 32 is movable up and down and the key switch 31 is moved with the bracket portion 30, that is, with the sliding member 25*a*. The key 32 is received in an elongate aperture 34 formed through a portion of the paper pan 2 along one of the opposite long sides of the rectangle of the rectangular recess 23, which portion includes a part of the thin-walled portion 24. When the sliding member 25a is moved, the key 32 is moved in the elongate aperture 34, with the switch 33 which is also secured to the bracket 30**.

While the present invention has been described in its presently preferred embodiments, it is to be understood that the invention is not limited to the details of the illustrated embodiments, but may be embodied with various changes, modifications and improvements, which may occur to those skilled in the art, without departing from the spirit and scope of the invention defined in the following claims.

What is claimed is:

1. A manual sheet feeding apparatus for manually feeding a cut sheet into a printer, comprising:

a paper pan having a surface for supporting said cut sheet manually inserted to a predetermined position;

a sheet guide provided on said paper pan for guiding said cut sheet along one edge thereof;

sheet advancing means disposed ahead of said paper pan, for advancing said cut sheet manually inserted, from said predetermined position along a feed path in a sheet advancing direction parallel to said one edge, in contact with said cut sheet;

operator-controlled commanding means for starting an operation of said sheet advancing means to advance said cut sheet, said operator-controlled commanding means including an operating surface for contact with a hand of an operator for activating said sheet advancing means; and said operating surface of said operator-controlled commanding means being different from said surface of said paper pan for supporting said cut sheet and spaced from said sheet guide and said feed path of said cut sheet in a direction which is perpendicular to said sheet advancing direction and parallel to said surface of said paper pan, such that a distance between nearest points of said operating surface and said sheet guide is a maximum of 15 cm.

2. A manual sheet feeding apparatus according to claim 1, wherein said operating surface of said operator-controlled commanding means has substantially the same height as a top surface of said paper pan on which said cut sheet is supported.

3. A manual sheet feeding apparatus according to claim 2, wherein said distance is a maximum of 7 cm.

4. A manual sheet feeding apparatus according to claim 1, wherein said sheet guide is provided on a movable member movable in said direction perpendicular to said sheet advancing direction and parallel to said surface of said paper pan, and said operator-controlled commanding means is provided on a stationary member separate from said movable member.

5. A manual sheet feeding apparatus according to claim 1, wherein said sheet guide and said operator-controlled commanding means are provided on a movable member which is movable in said direction perpendicular to said sheet advancing direction and parallel to said surface of said paper pan, such that said commanding means is moved with said sheet guide.

6. A manual sheet feeding apparatus according to claim 1, wherein said operator-controlled commanding means comprises a key which is movable to an operated position by pressing by an operator, and a switch which generates a start signal for operating said sheet advancing means, in response to a movement of said key to said operated position.

7. A manual sheet feeding apparatus according to claim 1, further comprising:

a sheet sensor for generating a sheet detection signal while said cut sheet manually inserted is in place with a leading edge thereof located at said predetermined position;

a timer for measuring a length of time during which said sheet detection signal is present; and automatic commanding means for starting the operation of said sheet advancing means to advance said cut sheet, when said length of time measured by said timer has exceeded a predetermined time.

8. A manual sheet feeding apparatus for manually feeding a cut sheet into a printer, comprising:

a paper pan having a surface for supporting said cut sheet manually inserted to a predetermined position;

a sheet guide provided on said paper pan for guiding said cut sheet along one edge thereof;

sheet advancing means disposed ahead of said paper pan, for advancing said cut sheet manually inserted from said predetermined position in a sheet advancing direction parallel to said one edge, in contact with said cut sheet;

operator-controlled commanding means for starting an operation of said sheet advancing means to advance said cut sheet, said operator-controlled commanding means including an operating surface for contact with a hand of an operator for activating said sheet advancing means, said operating surface having substantially the same height as a top surface of said paper pan on which said cut sheet is supported; and said operating surface of said operator-controlled commanding means being different from said surface of said paper pan supporting said cut sheet and disposed adjacent said sheet guide, said operating surface being spaced from said sheet guide and outside a feed path of said cut sheet in a direction which is perpendicular to said sheet advancing direction and parallel to said surface of said paper pan.

9. A manual sheet feeding apparatus for manually feeding a cut sheet into a printer, comprising:

a paper pan having a surface for supporting said cut sheet manually inserted to a predetermined position;

a sheet guide provided on said paper pan for guiding said cut sheet along one edge thereof;

sheet advancing means disposed ahead of said paper pan, for advancing said cut sheet manually inserted from said predetermined position in a sheet advancing direction parallel to said one edge, in contact with said cut sheet;

operator-controlled commanding means for starting an operation of said sheet advancing means to advance said cut sheet, said commanding means including an operating portion for contact with a hand of an operator for activating said sheet advancing means; and said operating portion of said operator-controlled commanding means being different from said surface of said paper pan and spaced from said sheet guide and outside a feed path of said cut sheet in a direction which is perpendicular to said sheet advancing direction and parallel to said surface of said paper pan, said operator-controlled commanding means being disposed relative to said sheet guide so that said operating portion can be operated by an operator's hand while said operator's hand is holding said cut sheet which is in contact with said sheet guide at said one edge.

10. A manual sheet feeding apparatus according to claim 9, wherein said operator's hand is a right hand, and said commanding means is spaced apart from said sheet guide by a distance which permits a thumb finger of said right hand to operate said commanding means while the other fingers of said right hand are holding said cut sheet.

* * * * *